US005685701A

United States Patent [19]

Chandler et al.

[11] Patent Number: 5,685,701

[45] Date of Patent: Nov. 11, 1997

[54] BEARING ARRANGEMENT FOR MOLTEN ALUMINUM PUMPS

[75] Inventors: Richard C. Chandler, Solon; George S. Mordue, Ravenna, both of Ohio

[73] Assignee: Metaullics Systems Co., L.P., Solon, Ohio

[21] Appl. No.: 457,571

[22] Filed: Jun. 1, 1995

[51] Int. Cl.[6] ..... F04B 17/03

[52] U.S. Cl. ..... 417/424.1; 266/235

[58] Field of Search ..... 417/423.1, 424.1, 417/423.6; 164/337; 222/595; 266/233, 235, 239; 415/200, 229

[56] References Cited

U.S. PATENT DOCUMENTS

| | | | |
|---|---|---|---|
| 2,515,478 | 7/1950 | Tooley et al. | 266/233 |
| 3,612,715 | 10/1971 | Yedidiah | 415/131 |
| 3,776,660 | 12/1973 | Anderson et al. | 415/196 |
| 3,861,660 | 1/1975 | Ammann et al. | 266/235 |
| 3,871,872 | 3/1975 | Downing et al. | 266/235 |
| 4,351,514 | 9/1982 | Koch | 266/235 |
| 4,511,315 | 4/1985 | Kanbe | 417/366 |
| 4,534,712 | 8/1985 | Kanbe | 417/366 |
| 4,545,741 | 10/1985 | Tomioka et al. | 417/365 |
| 4,804,168 | 2/1989 | Otsuka et al. | 266/235 |
| 4,884,786 | 12/1989 | Gillespie | 266/235 |
| 5,092,821 | 3/1992 | Gilbert et al. | 464/152 |
| 5,181,828 | 1/1993 | Gilbert | 415/200 |
| 5,203,681 | 4/1993 | Cooper | 417/424.1 |
| 5,454,423 | 10/1995 | Tsuchida et al. | 164/337 |

FOREIGN PATENT DOCUMENTS

| | | | |
|---|---|---|---|
| 610924 | 12/1960 | Canada | 415/200 |

*Primary Examiner*—Timothy Thorpe
*Assistant Examiner*—Peter G. Korytnyk
*Attorney, Agent, or Firm*—Fay, Sharpe, Beall, Fagan, Minnich & McKee

[57] ABSTRACT

A molten aluminum pump comprised of an impeller attached to a vertical rotary shaft, the shaft forming a connecting portion between a motor and the impeller and being comprised of a refractory material without a radial bearing surface. The impeller is housed within a pumping chamber of a base member wherein rotation of the shaft and impeller draws molten aluminum into the chamber and forces the molten aluminum through an outlet in the chamber. The motor is secured to the shaft with a rigid coupling and at least one bearing journaling the coupling.

14 Claims, 5 Drawing Sheets

BEARING ARRANGEMENT FOR MOLTEN ALUMINUM PUMPS

BACKGROUND OF THE INVENTION

This invention relates to molten aluminum pumps. Particularly, this invention relates to a life extending bearing assembly for centrifugal molten aluminum pumps. More particularly, the invention is directed to a molten aluminum pump including a rotatable shaft rigidly connecting a motor and an impeller, wherein a bearing is positioned on an assembly coupling the motor to the shaft to augment or replace the traditional radial bearing surfaces on the shaft.

DESCRIPTION OF THE ART

The most popular design of molten aluminum pumps is comprised of a motor supported on a platform above a body of molten aluminum with a rotatable shaft extending into the molten aluminum to turn an impeller. The platform may be connected to a pump housing submerged in the molten aluminum with a plurality of refractory posts or a central support tube. The rotatable shaft extends from the motor through the platform and into the pump housing submerged in the molten aluminum within which the impeller is rotated. Rotation of the impeller therein causes a directed flow of molten aluminum. U.S. Pat. Nos. 2,948,524; 3,048,384; 3,836,280; 4,786,230; 4,940,384; 5,028,211; 5,078,572; 5,080,893; 5,092,821; 5,165,858; 5,181,828; 5,203,681; and, 5,330,328 describe molten aluminum pump constructions of this type and are herein incorporated by reference.

In these prior designs, the molten aluminum pumps are typically constructed with a rotatable coupling such as a universal joint between the motor and a graphite shaft. Because the coupling traditionally allows at least minimal transverse movement, a stabilizing bearing is positioned on the shaft and/or the impeller to interface with the shaft bearing mount and/or the pump housing submerged in the molten aluminum. Although certain types of metal pumps, for example tin and/or lead pumps, function without a bearing on the shaft or impeller, this technology is of no help in a molten aluminum or molten zinc pump. Particularly, tin and lead pumps operate with steel shafts and pump housings wherein the components themselves—in conjunction with the lubricity of the metal—provide suitable bearing surfaces. In contrast, molten aluminum and molten zinc pumps must be constructed of refractory materials, for example graphite, which do not have the same type of inherent bearing properties. Accordingly, bearings of materials such as silicon carbide are added to aluminum and zinc pumps.

A particularly good example of molten aluminum pump designs including a bearing on the shaft or impeller is provided by the Metaullics® M Series and L Series of pumps available from Metaullics Systems Co., L.P., 31935 Aurora Road, Solon, Ohio 44139. In these machines, the rotatable shaft or impeller is equipped with a bearing which interfaces with either (1) a shaft bearing mount, or (2) the pump housing. Accordingly, in prior molten aluminum pumps, a radial bearing surface is provided on the graphite shaft or impeller to prevent excessive "wobble" of the impeller in the pump housing which could lead to destruction of the impeller, pump housing, and/or other pump components.

Since the rotatable shaft is preferably comprised of a refractory material, typically graphite, it has historically been among the shortest lived components of a molten aluminum pump. Particularly, the highly corrosive environment in which the shaft is rotated causes rapid degradation, especially of the radial bearing surfaces which are also comprised of refractory materials. In this regard, degradation of the radial bearings destroys the precise fit required to maintain optimum performance. In addition, the bearings positioned in or near the molten aluminum which rapidly degrade can develop a "wobble" in the impeller, which alone or in combination with clogging with debris can lead to a pump failure.

Accordingly, it would be desirable in this art to provide a molten metal pump which allows for efficient rotation of an impeller without the presence of a bearing surface on a submerged portion of the rotatable refractory shaft and impeller.

SUMMARY OF THE INVENTION

Accordingly, it is a primary object of this invention to provide a new and improved molten aluminum pump.

It is an advantage of this invention to provide a new and improved molten aluminum pump that enjoys a longer operable life by extending the life of the rotatable shaft.

A further advantage of this invention is to provide a coupling between the motor and rotatable graphite shaft which alleviates the requirement of a radial bearing surface on the shaft.

An additional advantage of this invention is the replacement of the refractory bearing assembly with a longer lasting steel type bearing.

Additional objects and advantages of the invention will be set forth in part in the description which follows and in part will be obvious from the description, or may be learned by practice of the invention. The objects and advantages of the invention may be realized and attained by means of the instrumentalities and combinations, particularly pointed out in the appended claims.

To achieve the foregoing objects and in accordance with the purpose of the invention, as embodied and broadly described herein, the molten aluminum or zinc pump of this invention comprises an impeller attached to a vertical rotary shaft comprised of a refractory material, preferably graphite or ceramic. The shaft forms a connection between a motor and the impeller housed within a pumping chamber. The shaft is secured to the motor with a rigid coupling and at least one bearing journals the coupling to maintain a stable shaft alignment.

BRIEF DESCRIPTION OF THE DRAWINGS

The invention consists in the novel parts, construction, arrangements, combinations, and improvements shown and described. The accompanying drawings, which are incorporated in and constitute a part of the specification, illustrate one embodiment of the invention and, together with the description, serve to explain the principles of the invention.

Of the drawings.

DETAILED DESCRIPTION OF THE INVENTION

Reference will now be made in detail to the present preferred embodiment of the invention, an example of which is illustrated in the accompanying drawings, wherein like elements are represented by like numerals. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined by the appended claims.

Figure 1:
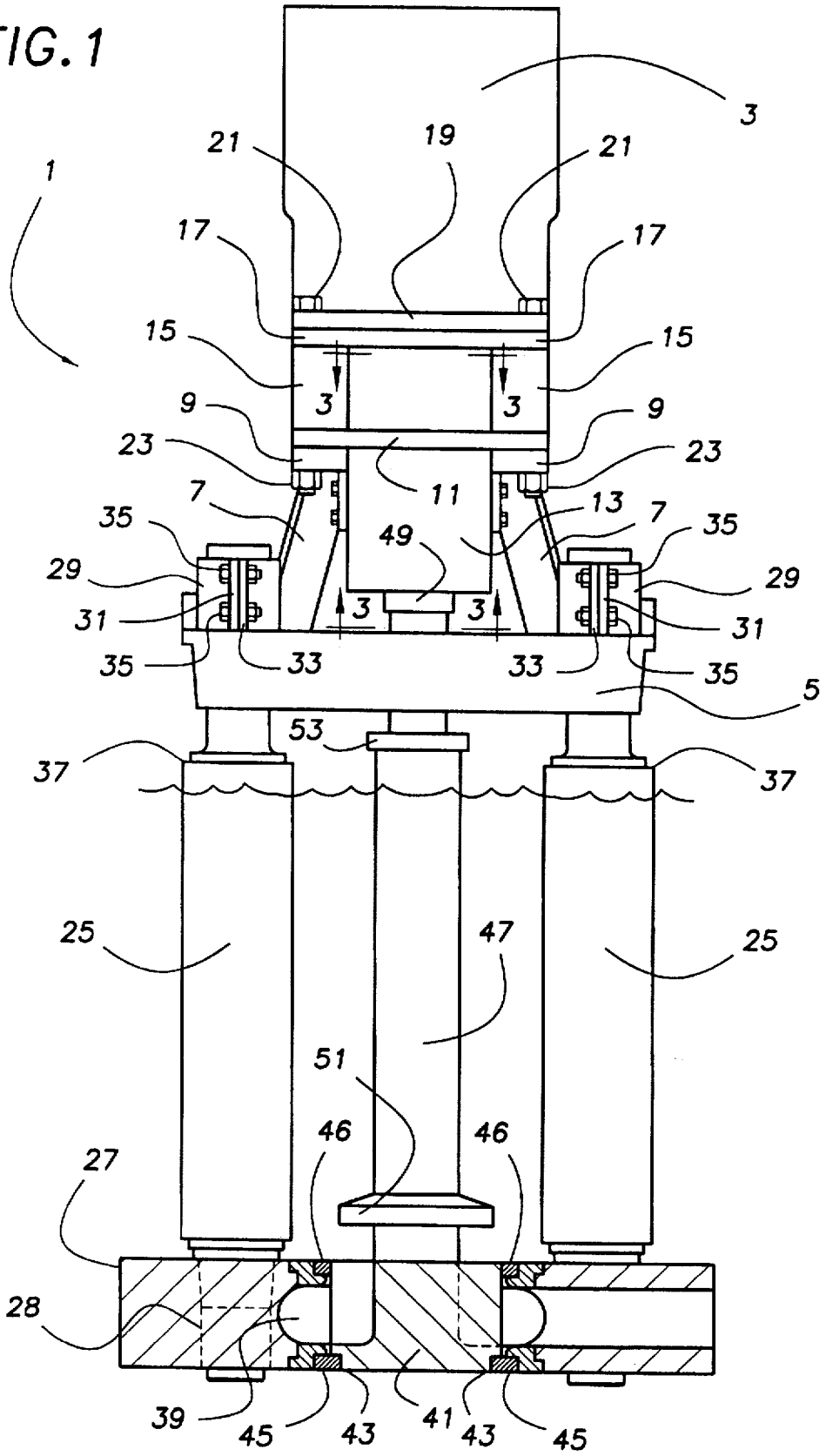
FIG. 1 is a side elevation view of the inventive molten aluminum pump, showing the pumping chamber in cross-section.

Referring now to FIG. 1, it may be seen that the molten metal pump 1 is comprised of a motor 3, which may be driven electrically, hydraulically, pneumatically, or by any other method known to those skilled in the art, supported on platform 5 by three struts 7 (only two of which are shown). Struts 7 are bolted, welded, or secured by any means known to those skilled in the art at a first end to platform 5. Platform 5 is constructed of metal and refractory materials as known to those skilled in the art and described in U.S. Pat. No. 5,181,828. A second end of each strut 7 includes a shoulder 9, mated to flange 11 of coupling jacket 13. Spacing element 15 and a second flange 17 of coupling jacket 13 are positioned above flange 11 to support motor 3. A bore through shoulder 9, flanges 11 and 17, and spacing member 15 is aligned with a hole in mating surface 19 of motor 3. Bolt 21 and nut 23 secure these elements together and, therefore, motor 3 to platform 5.

It should be noted that the inventive drive shaft arrangement is not limited to the depicted motor mount or platform. In fact, a variety of alternative motor mount designs known in the art will benefit from incorporation of the subject inventive coupling/bearing assembly.

Three (only two of which are shown) posts 25, constructed of graphite or other refractory materials, extend between platform 5 and pump base 27. Posts 25 extend through and are secured to plate 5 by semicircular clamps 29 joined at cooperating flanges 31 and 33 by bolt/nut combinations 35. Of course, any method of securing the posts to the platform is acceptable. Posts 25 extend downward and are secured by any means known to those skilled in the art, such as with a refractory cement, into holes 28 of pump base 27. In this embodiment, posts 25 include a protective sheath 37 comprised of silicon carbide.

Figure 6:
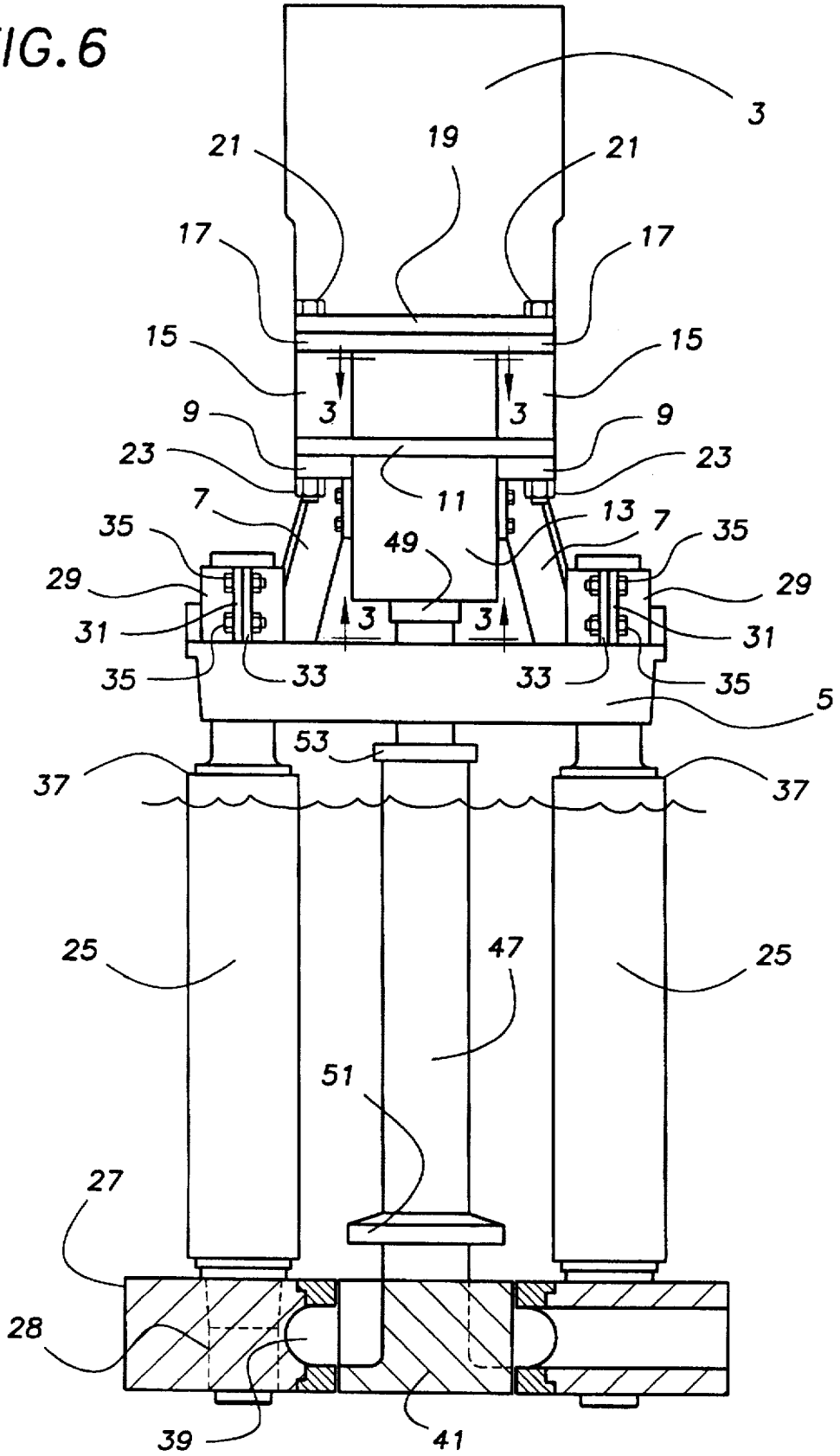
FIG. 6 is a side elevation view of the inventive molten metal pump, showing the pump chamber in cross-section and the absence of a radial bearing surrounding the impeller.

Base 27 includes a pumping chamber 39 housing impeller 41 mounted on shaft 47. Impeller 41 is secured to shaft 47 by any means known to those skilled in the art, such as refractory cement, threads, dowels, quadrilobal engagement, etc. In the depicted embodiment, the bottom peripheral circumference of impeller 41 includes a bearing surface opposed by a bearing material 45, such as silicon carbide, in pump chamber 39. A second bearing ring 46 is also included in the upper circumference of pumping chamber 39. However, in a preferred embodiment, the impeller is free of radial bearing surfaces (see FIG. 6). Since the bearings on the impeller/pump chamber interface are not necessary, a bottom and top feed pump is therefore practical.

In this particular embodiment, shaft 47 is equipped with baffle plate 51 to reduce suction of large inclusions into the rotating impeller. Splash guard 53 is also included to reduce spray of molten aluminum upward through a bore (not shown) in support plate 5.

Figure 2:
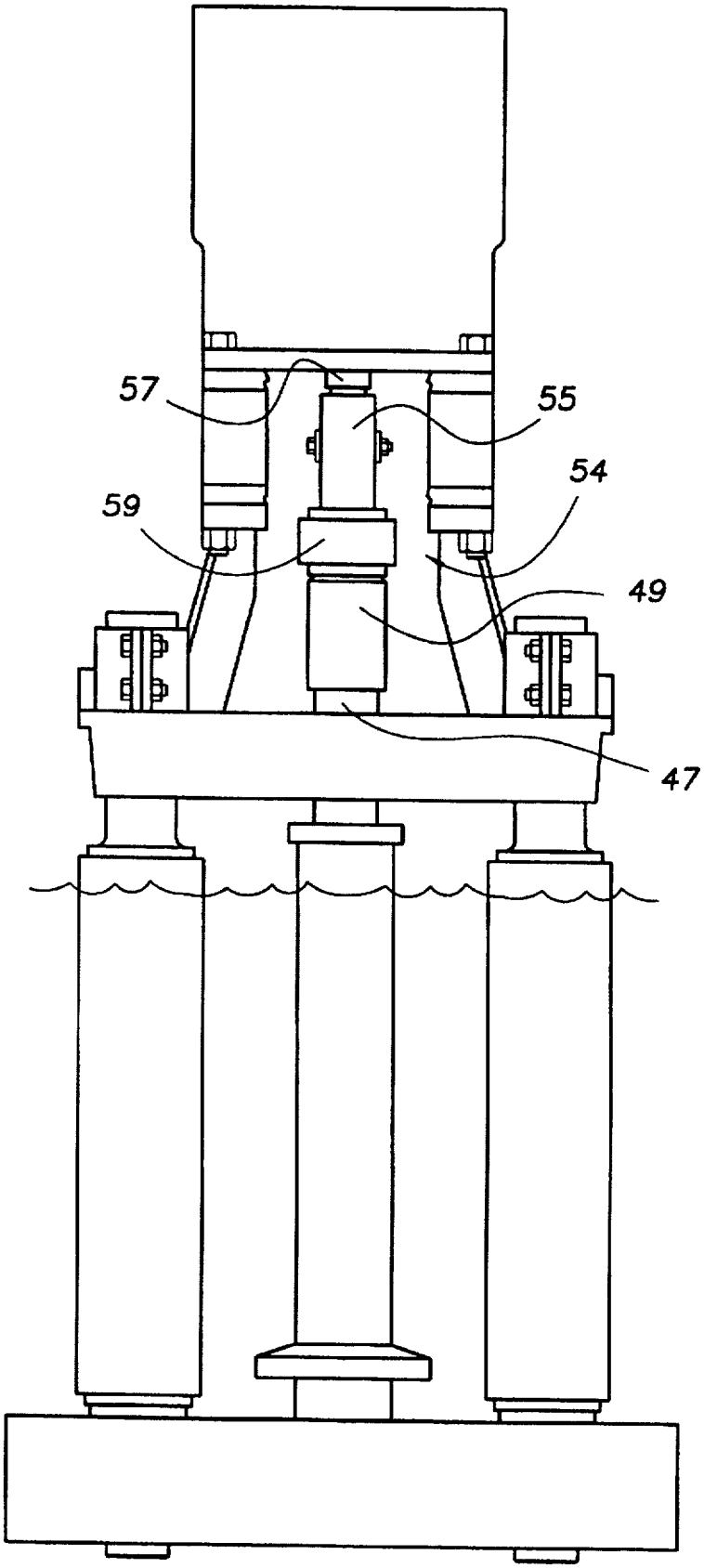
FIG. 2 is a side elevation view of the inventive molten metal pump having the coupling jacket removed.

Referring now to FIG. 2, having coupling jacket 13 removed, the inventive coupling arrangement 54 can be seen. Particularly, shaft 47, preferably having a quadrilobal end 79 as disclosed in U.S. Pat. No. 5,092,821, herein incorporated by reference, is housed in coupling receptacle 49. Coupling receptacle 49 is integrally formed to coupling body 55 which is attached to motor shaft 57. A bearing 59 is positioned on coupling body 55 to limit transverse movement of coupling 54 and, therefore, rigidly connect shaft 47. Since the inventive coupling arrangement substantially eliminates "wobble" of the shaft, bearing surfaces on the shaft in the molten metal environment can be eliminated. Bearing 59 can be a double tapered roller bearing cartridge available from the Dodge Division of Reliance Electric.

Figure 3:
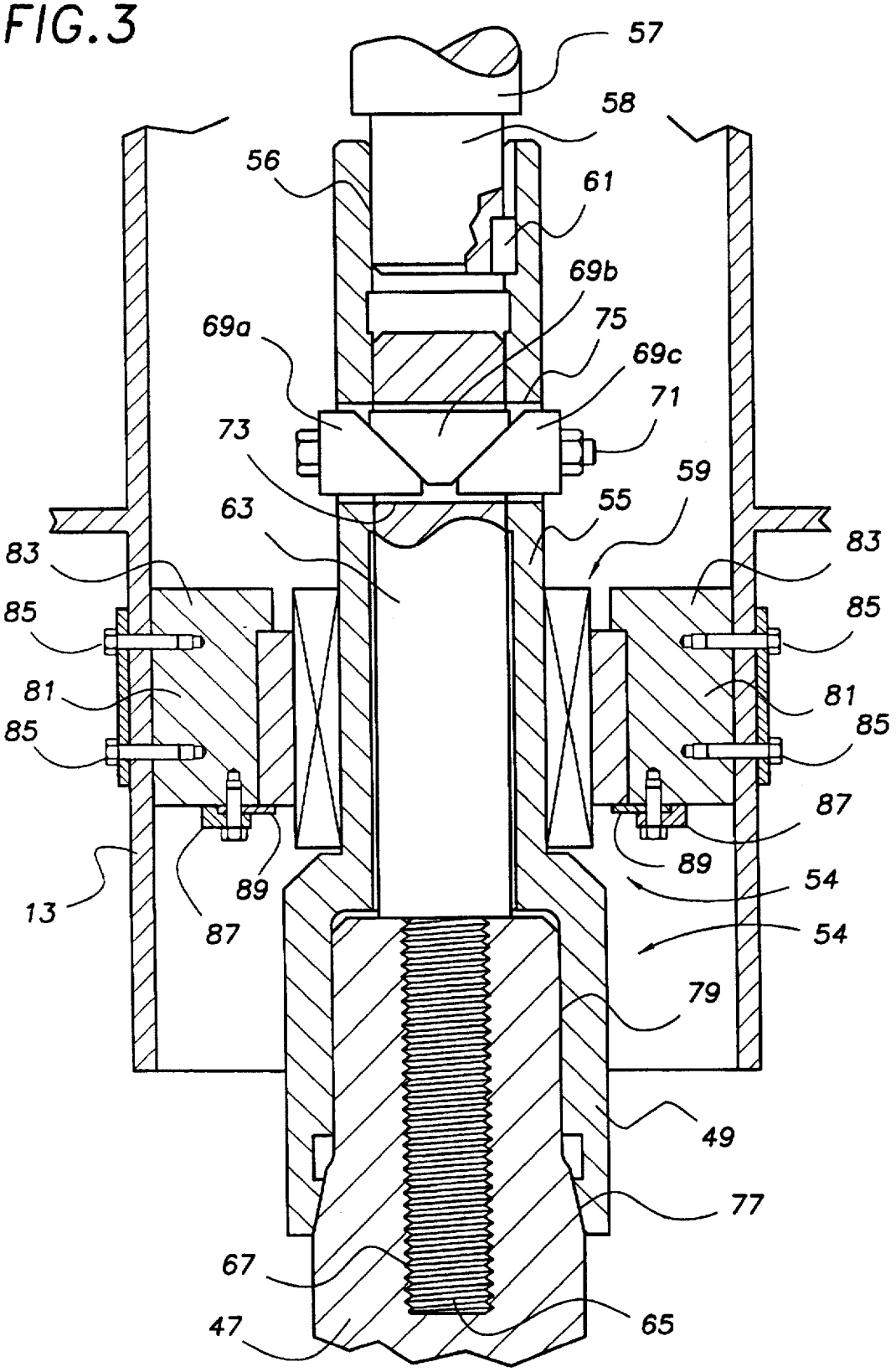
FIG. 3 is a cross-sectional exploded view taken along lines 3—3 of FIG. 1.

The coupling arrangement 54 can be seen in detail in FIG. 3. Particularly, motor drive shaft 57 includes a step-down portion 58 which enters bore 56 of coupling body 55. In a typical construction, the shaft of the motor will be stabilized with at least one bearing. Motor shaft 58 is rotationally secured within coupling body 55 by key 61. Dowel 63, having reduced diameter threaded portion 65 extends between bore 56 of coupling body 55 and coupling receptacle 49. Portion 65 of dowel 63 is threadably engaged in a threaded hole 67 in shaft 47. As will be recognized by those skilled in the art, the threaded coupling between shaft and coupling provides for height adjustment. Dowel 63 is secured within coupling body 55 by means of cooperative wedge members 69*a*, 69*b*, and 69*c*, drawn together with nut/bolt combination 71.

Figure 5:
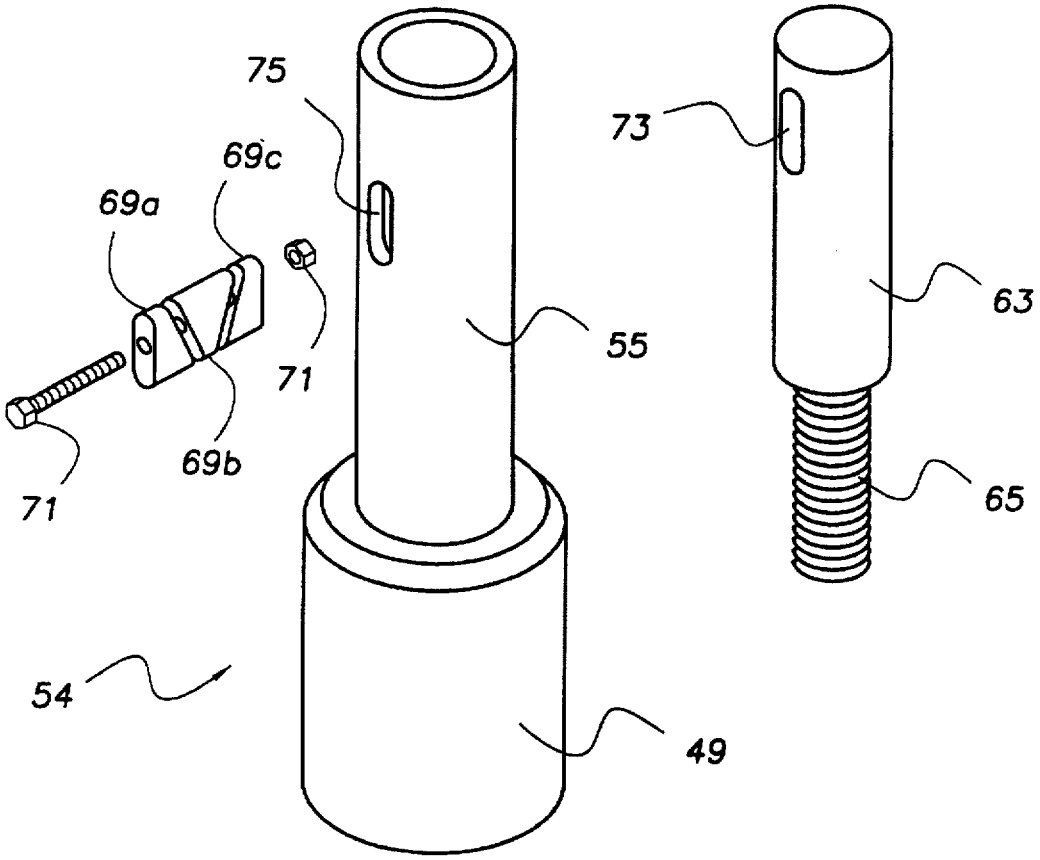
FIG. 5 is a perspective view of the coupling mechanism.

In this arrangement (see also FIG. 5), dowel 63 and coupling body 55 include aligned passages 73 and 75 respectively. Three cooperative wedges 69*a*, 69*b*, 69*c* are positioned within the passages. When nut/bolt combination 71 is tightened, an upward drawing force is exerted by the cooperative wedges on dowel 63, pulling shaft 47 upward into a mated relationship with canted surface 77 and the quadrilobal walls 79 of lower coupling receptacle 49.

Although a particular coupling arrangement is depicted, the invention is not limited to that specific embodiment. Moreover, the invention includes any coupling arrangement which provides a rigid connection between the motor drive shaft and the rotary refractory shaft. As used herein, "rigid" is intended to mean limited transverse motion.

Figure 4:
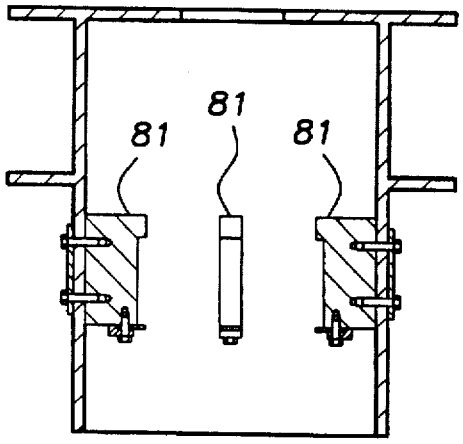
FIG. 4 is a detailed cross-sectional view of the coupling jacket.

As best seen in FIGS. 3 and 4, the bearing 59 is secured by four (only three are shown) clamps 81, each secured to coupling jacket 13. Each clamp 81 is comprised of a first member 83 secured by at least two screws 85 to coupling jacket 13. A latching mechanism 87 then secures bottom stop 89 to the clamps 81, and rigidly secures bearing 59 to coupling jacket 13 and coupling member 54.

Thus, it is apparent that there has been provided, in accordance with the invention, a molten aluminum pump that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A molten metal pump comprised of a rotary shaft of refractory material connecting a motor and an impeller with neither the shaft nor the impeller having a radial bearing surface, the impeller housed within a pumping chamber of a base member wherein rotation of said shaft and impeller draws molten aluminum into said chamber and forces molten aluminum through an outlet in said chamber, said motor being secured to said shaft by a rigid coupling and at least one bearing journaling said coupling.

2. The pump of claim 1 wherein said pump includes bottom and top inlets to said pumping chamber.

3. The pump of claim 1 wherein said shaft is comprised of graphite.

4. The pump of claim 1 wherein said coupling is comprised of a receptacle portion accommodating said shaft and a dowel coupled to said shaft.

5. The pump of claim 4 wherein a cooperative set of wedges urge said dowel and said shaft into a mated relationship with said receptacle.

6. The pump of claim 5 wherein said receptacle is integrally formed to a body, said body being rigidly attached to a drive shaft of said motor.

7. The pump of claim 6 wherein said bearing journals said body.

8. The pump of claim 7 wherein said bearing is comprised of steel.

9. The pump of claim 1 wherein said molten metal is zinc.

10. The pump of claim 1 wherein said molten metal is molten aluminum.

11. A molten aluminum pump comprised of a rotary shaft of refractory material connecting a motor and an impeller, the impeller, free of a radial bearing surface being housed within a pumping chamber of a base member wherein rotation of said shaft and impeller draws molten aluminum into said chamber and forces molten aluminum through an outlet in said chamber, said motor being secured to said shaft by a rigid coupling and at least one bearing journaling said coupling.

12. The pump of claim 11 wherein said shaft is comprised of graphite.

13. The pump of claim 11 wherein said impeller is comprised of graphite.

14. A molten aluminum pump comprised of a rotary shaft of refractory material connecting a motor and an impeller, the impeller housed within a pumping chamber of a base member wherein rotation of said shaft and impeller draws molten aluminum into said chamber and forces molten aluminum through an outlet in said chamber, said motor being secured to said shaft by a rigid coupling and at least one bearing journaling said coupling, said shaft being free of a radial bearing surface.

* * * * *